US007131900B2

(12) United States Patent
Chou

(10) Patent No.: US 7,131,900 B2
(45) Date of Patent: Nov. 7, 2006

(54) GRINDING WHEEL IN COMBINATION WITH A GRINDING RING

(76) Inventor: Samuel Chou, 5FL., No. 4, Lane 315, Sec. 2, Jungshan Rd., Junghe City, Taipei (TW)

( * ) Notice: Subject to any disclaimer, the term of this patent is extended or adjusted under 35 U.S.C. 154(b) by 0 days.

(21) Appl. No.: 10/724,452

(22) Filed: Nov. 28, 2003

(65) Prior Publication Data

US 2005/0026557 A1 Feb. 3, 2005

(30) Foreign Application Priority Data

Jul. 28, 2003 (TW) ..... 92213708 U

(51) Int. Cl.
*B24D 17/00* (2006.01)

(52) U.S. Cl. ..... 451/520; 451/177; 451/259; 451/268; 451/520; 451/526; 451/527; 451/529; 451/532

(58) Field of Classification Search ..... 451/177, 451/259, 268, 520, 526, 527, 529, 532
See application file for complete search history.

(56) References Cited

U.S. PATENT DOCUMENTS 3,991,526 A * 11/1976 Frank et al. ..... 451/490

* cited by examiner

*Primary Examiner*—Joseph J. Hail, III
*Assistant Examiner*—Shantese McDonald

(57) ABSTRACT

A combination between a grinding ring and a grinding wheel is disclosed, wherein the grinding ring has a centrally defined hole, a tubular extension extending from a periphery defining the hole, an annular extension extending from an outer periphery of the tubular extension, a skirt formed adjacent to the annular extension, teeth formed by pressing at a joint between the annular extension and the skirt and barbs each formed on a free end of the teeth. The grinding wheel is made of cloth so that the teeth together with the bars are able to extend into the grinding wheel when the skirt is pressed and engagement between the grinding ring and the grinding wheel is enhanced by applying an adhesive.

3 Claims, 17 Drawing Sheets

GRINDING WHEEL IN COMBINATION WITH A GRINDING RING

BACKGROUND OF THE INVENTION

1. Field of the Invention

The present invention relates to a grinding wheel in combination with a grinding ring, and more particularly to a grinding ring having multiple teeth formed on a peripheral edge of the grinding ring and a tubular extension centrally formed on a center of the grinding ring such that when the grinding ring is combined with the grinding wheel, extension of the teeth of the grinding ring into the grinding wheel is able to enhance the combining force therebetween.

2. Description of Related Art

A conventional grinding wheel assembly is shown in FIG. 15, which includes a grinding ring 10*a* and a grind wheel 20*a*. The grinding ring 10*a* is a shallow disk and has a central hole 11*a*, a tubular extension 12*a* extending from a peripheral edge defining the central hole 11*a*, a first annular extension 13*a* extending from an outer periphery of the tubular extension 12*a*, a flange 15*a* formed around an outer peripheral edge of the first annular extension 13*a* and a second annular extension 14*a* extending from an outer periphery of the flange 15*a*. The grinding wheel 20*a* has a hole 21*a* corresponding to the flange 15*a*. When the grinding ring 10*a* is to be combined the grinding wheel 20*a*, the flange 15*a* of the grinding ring 10*a* is extended into the hole 21*a* and an adhesive is applied to secure the engagement between the flange 15*a* and an inner periphery defining the hole 21*a*.

Another conventional grinding wheel assembly is shown in FIG. 16 of the attached drawings, which includes a grinding ring 30*a* and a grinding wheel 20*a*. The grinding ring 30*a* is a shallow disk and has a central hole 31*a*, a tubular extension 32*a*, an annular extension 33*a* extending from an outer periphery of the tubular extension 32*a* and teeth 34*a* formed on a peripheral edge of the annular extension 33*a*. When combining the grinding ring 30*a* and the grinding wheel 20*a* is necessary, the teeth 34*a* is inserted into the grinding wheel 20*a* and an adhesive is applied from the central hole 31*a* to secure the engagement therebetween.

A further conventional grinding wheel assembly is shown in FIG. 17 of the attached drawings, which includes a grinding ring 40*a* and a grinding wheel 50*a*. The grinding ring 40*a* is a shallow disk and has a central hole 41*a*, a tubular extension 42*a* extending from a periphery defining the central hole 41*a*, an annular extension 43*a* extending from an outer periphery of the tubular extension 42*a* and teeth 44*a* extending from a bottom face of the annular extension 43*a*, each tooth 44*a* having a barb 441*a* formed on a free end of the tooth 44*a* and a peripheral side 45*a* formed around the teeth 44*a*. The grinding wheel 50*a* is composed of multiple grinding plates 51*a* superposed on top of one another to form a circle. When the combination between the grinding wheel 50*a* and the grinding ring 40*a* is necessary, the teeth 44*a* is inserted into the grinding wheel 50*a* to allow the grinding ring 40*a* to cover all the grinding plates. Then an adhesive is applied from sides of the grinding ring 40*a* to securely engage the grinding plates of the grinding wheel 50*a* and combine the engagement between the grinding ring 40*a* and the grinding wheel 50*a*.

Although each of the grinding wheel assemblies initially has a firm combination between the grinding ring and the grinding wheel, there are still disadvantages making the combination unreliable, which are:

The grinding ring of FIG. 15 is made of plastic and has an area substantially the same as that of the grinding wheel. The adhesive seems the only solution to securely combine the engagement therebetween. Accordingly, the grinding ring is easily engaged with the polishing object and thus the surface of the polishing object is easily damaged. Further, the engagement between the grinding ring and the grinding wheel by the adhesive is not able to provide effective combining force and the grinding ring is easily fallen from the grinding wheel.

The grinding ring of FIG. 16 is made of metal such that using a mold to produce such a grinding ring with teeth formed on the periphery of the grinding ring. Besides, there is only the extension of the teeth into the grinding wheel to secure the engagement between the grinding ring and the grinding wheel, horizontal extension is not provided to the grinding ring such that when the grinding ring is polished, the grinding ring is easily broken due to lack of strength, which leads to a bad influence to the polishing surface of the object to be polished.

The conventional ring in FIG. 17 is made with a mold, temperature and pressure must be strictly controlled, resulting in high cost. Further, when the grinding ring is used with the grinding wheel having multiple grinding plates superposed together, the grinding ring is easily overturned due to lack of strength.

To overcome the shortcomings, the present invention intends to provide an improved grinding ring in combination with a grinding wheel.

SUMMARY OF THE INVENTION

A primary objective of the invention is to provide a grinding ring made by pressing and having a centrally defined hole and teeth formed on a periphery of the grinding ring such that when the grinding ring is combined with the grinding wheel, the extension of the teeth into the surface of the grinding wheel is able to enhance the engagement between the grinding ring and the grinding wheel.

Other objectives, advantages and novel features of the invention will become more apparent from the following detailed description when taken in conjunction with the accompanying drawings, in which:

DETAILED DESCRIPTION OF PREFERRED EMBODIMENT

Figure 1:
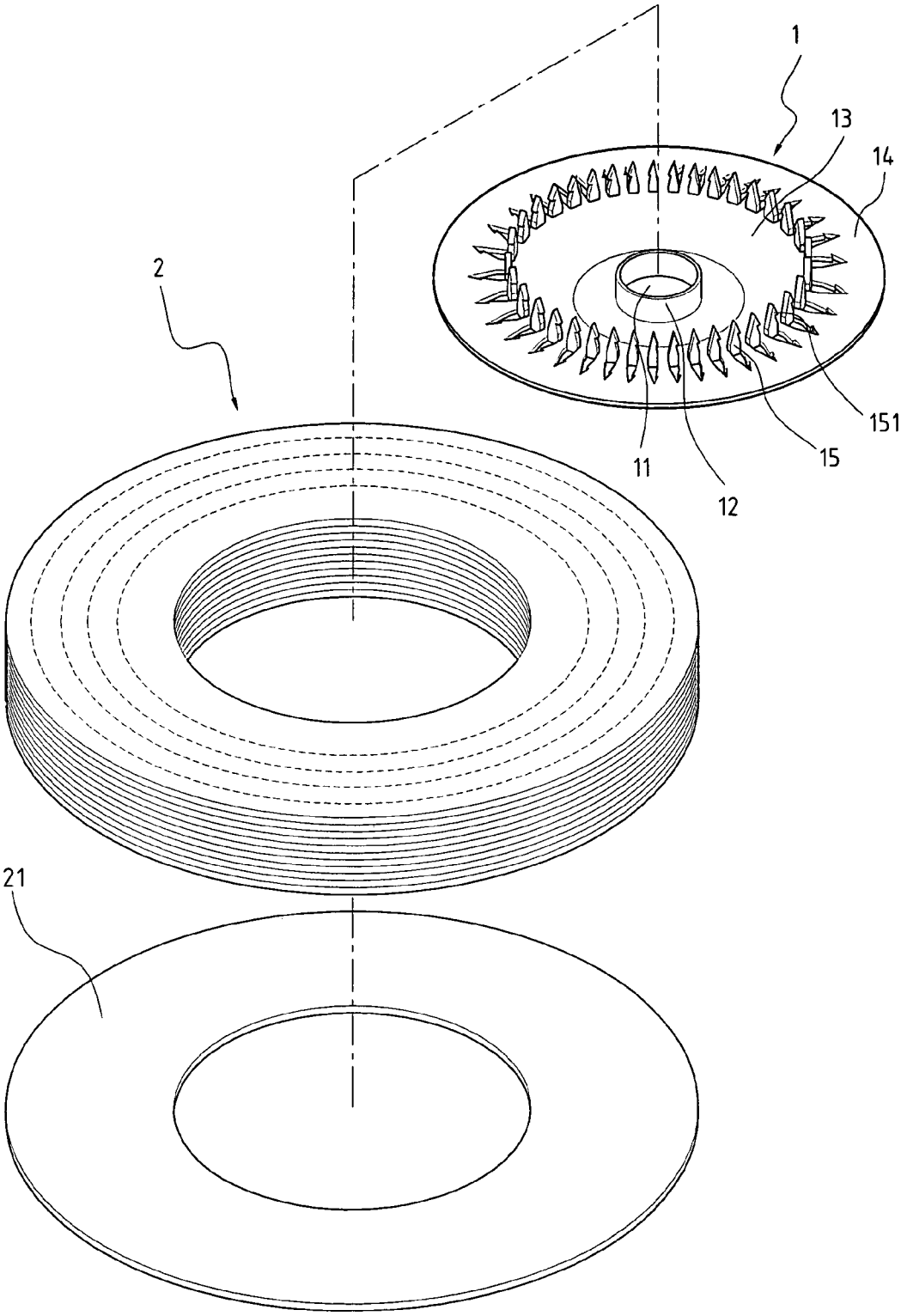
FIG. 1 is a perspective view of a grinding ring and a grinding wheel of the present invention.
Figure 2:
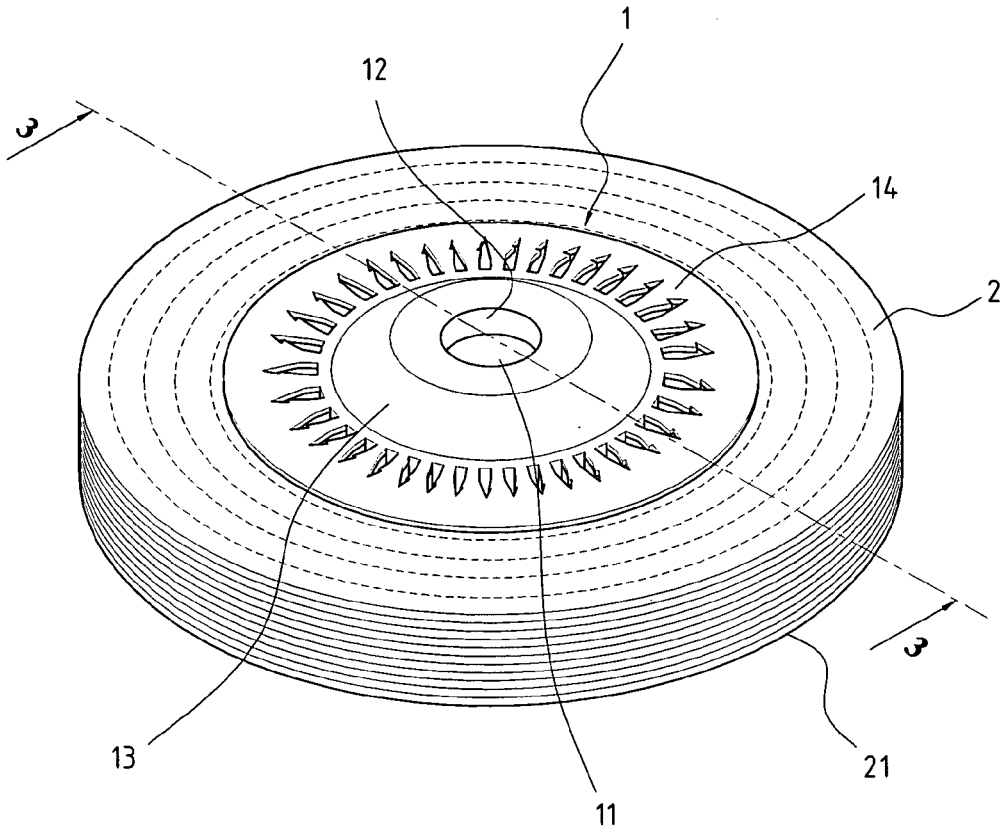
FIG. 2 is a perspective view showing the combination of the grinding ring and grinding wheel in FIG. 1.
Figure 3:
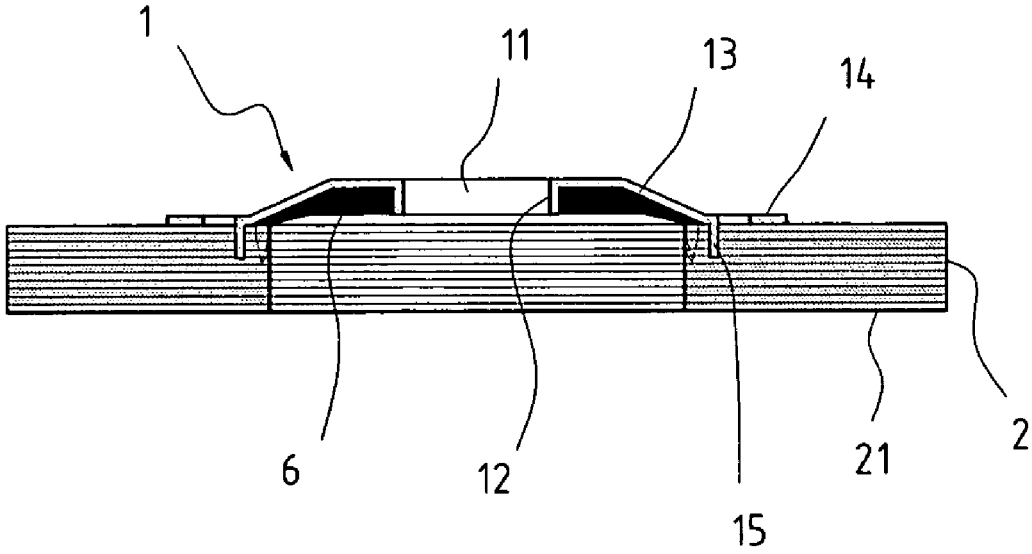
FIG. 3 is a cross-sectional view taken along line 3—3 in FIG. 2.

With reference to the drawings and in particular to FIGS. 1, 2 and 3, a grinding ring 1 in accordance with the present invention has a centrally defined hole 11, a tubular extension 12 extending from a periphery defining the hole 11, an annular extension 13 extending from an outer periphery of the tubular extension 12 and a skirt 14 formed adjacent to the extension 13. Multiple teeth 15 are pressed at a joint between the annular extension 13 and the skirt 14 and multiple barbs 151 are respectively formed on the teeth 15. The grinding wheel 2 is made of cloth made of wool. The cloth is on top of one another and then securely engaged with one another by any known method. When the combination between the grinding ring 1 and the grinding wheel 2 is required, the grinding ring 1 is placed on top of the grinding wheel 2. Then the grinding ring 1 is pressed downward to the grinding wheel 2. Due to the pressing process, the teeth 15 and the barbs 151 are formed and extended into the grinding wheel 2. An adhesive 6 is applied from the hole 11 to fill the space between the grinding ring 1 and the grinding wheel 2 so that engagement between the grinding ring 1 and the grinding wheel 2 is enhanced.

Figure 4:
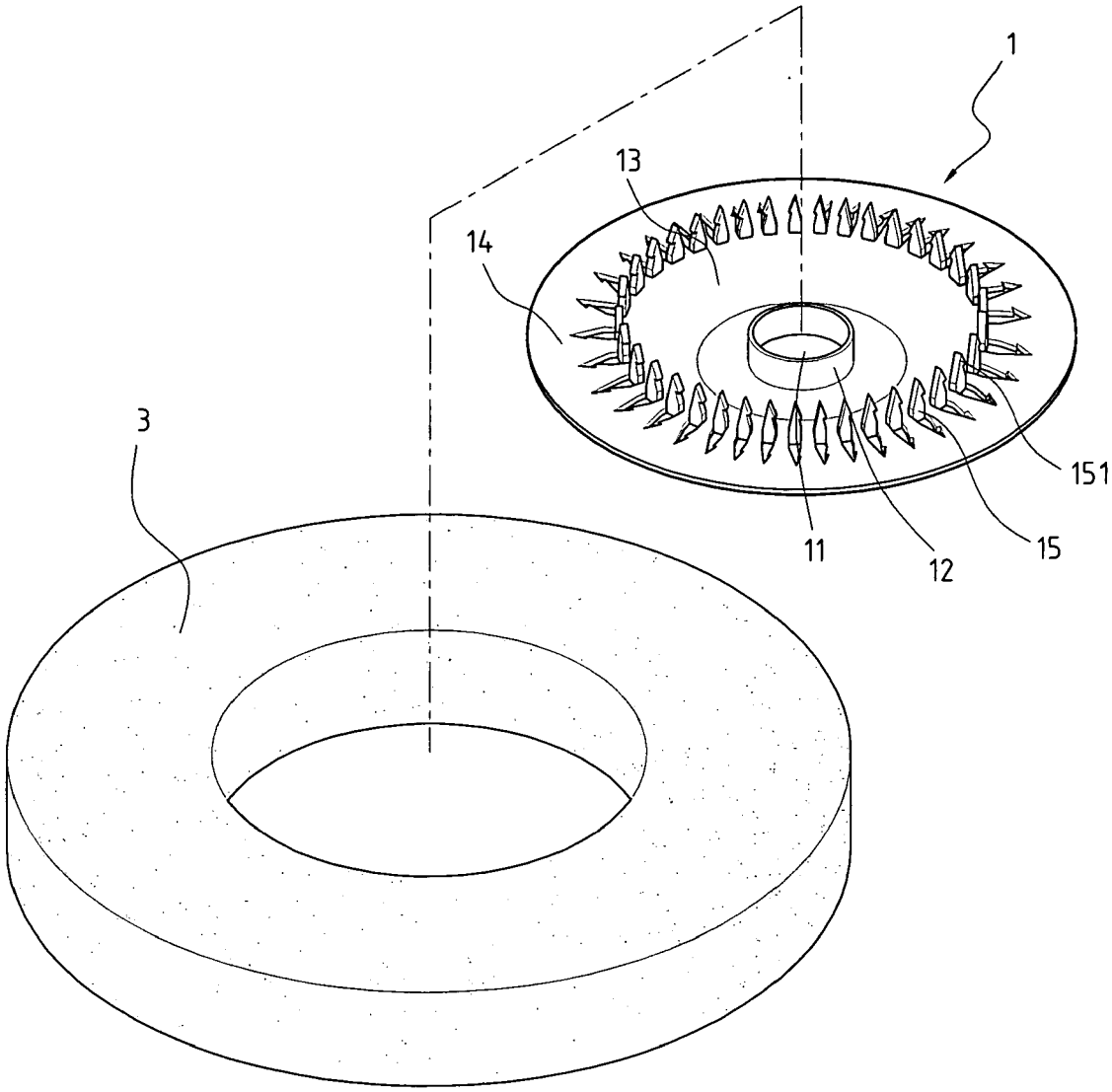
FIG. 4 is a perspective view of a grinding ring and a grinding wheel of a preferred embodiment of the present invention.
Figure 5:
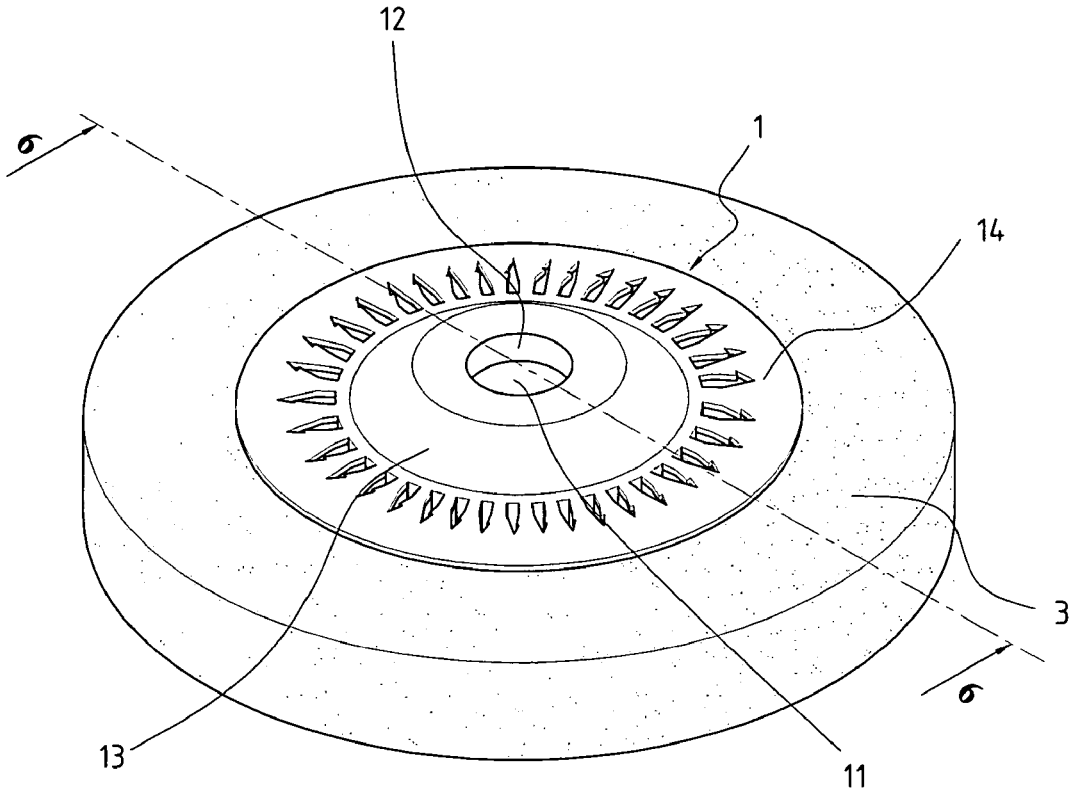
FIG. 5 is a perspective view showing the combination of the grinding ring and grinding wheel of FIG. 4.
Figure 6:
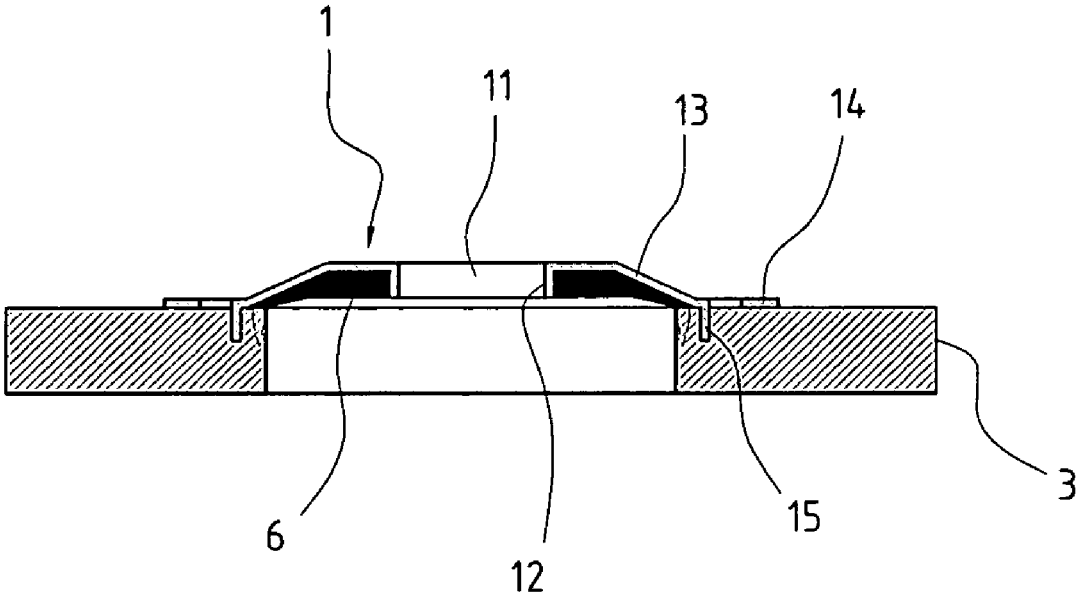
FIG. 6 is a cross-sectional view taken along line 6—6 in FIG. 5.

Also referring to FIGS. 4, 5 and 6, it is noted that the grinding ring in accordance with the present invention has a centrally defined hole 11, a tubular extension 12 extending from a periphery defining the hole 11, an annular extension 13 extending from an outer periphery of the tubular extension 12 and a skirt 14 formed adjacent to the extension 13. Multiple teeth 15 are pressed at a joint between the annular extension 13 and the skirt 14 and multiple barbs 151 are respectively formed on the teeth 15. The grinding wheel 3 is made of non-woven cloth and secured together by a machine. When the combination between the grinding ring 1 and the grinding wheel 3 is required, the grinding ring 1 is placed on top of the grinding wheel 3. Then the grinding ring 1 is pressed downward to the grinding wheel 3. Due to the pressing process, the teeth 15 and the barbs 151 are formed and extended into the grinding wheel 3. An adhesive 6 is applied from the hole 11 to fill the space between the grinding ring 1 and the grinding wheel 3 so that engagement between the grinding ring 1 and the grinding wheel 3 is enhanced.

Figure 7:
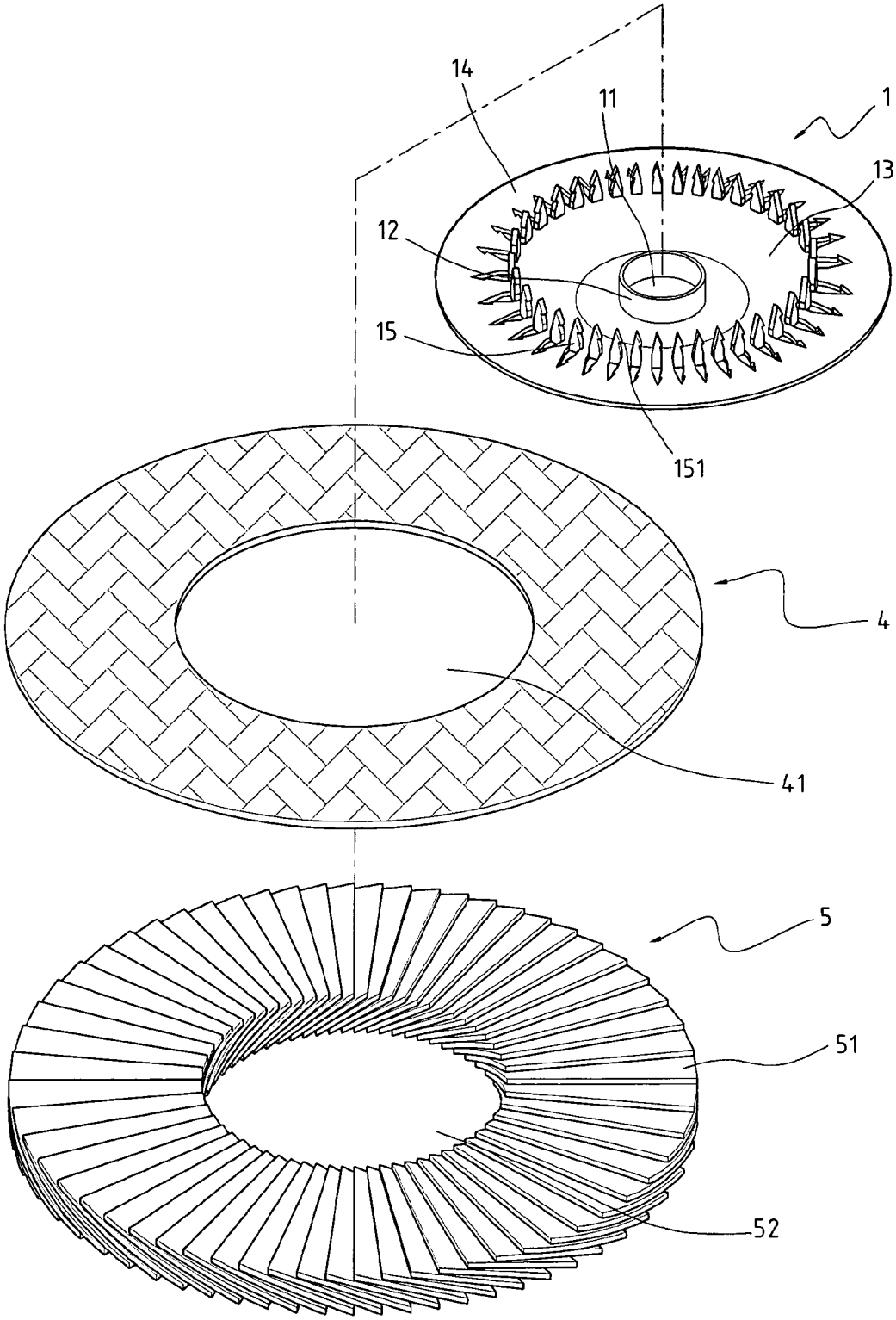
FIG. 7 is an exploded perspective view of the grinding ring and the grinding wheel of the present invention.
Figure 8:
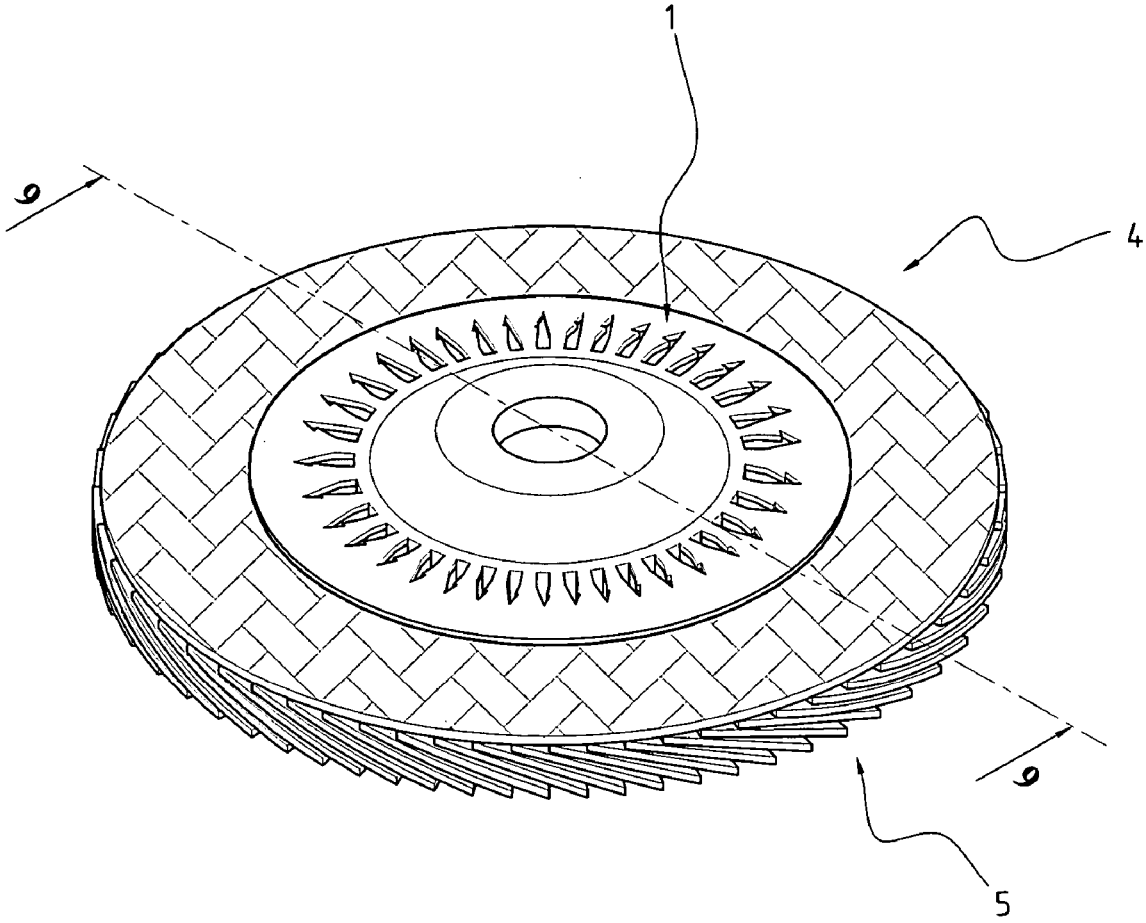
FIG. 8 is a perspective view of the combination of the grinding ring and the grinding wheel in FIG. 7.
Figure 9:
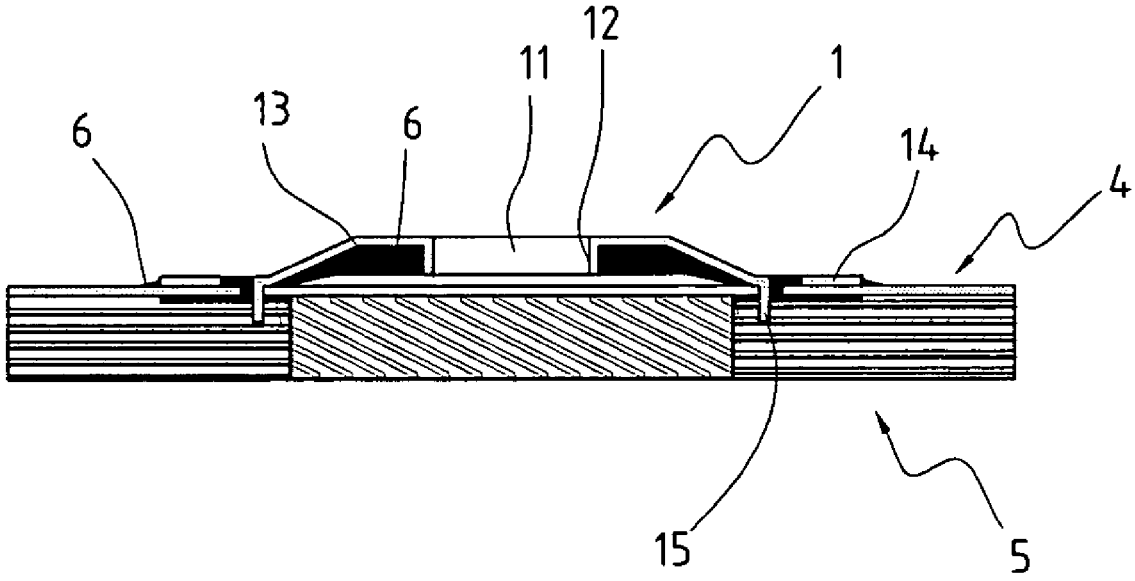
FIG. 9 is a cross-sectional view taken along line 9—9 in FIG. 8.
Figure 10:
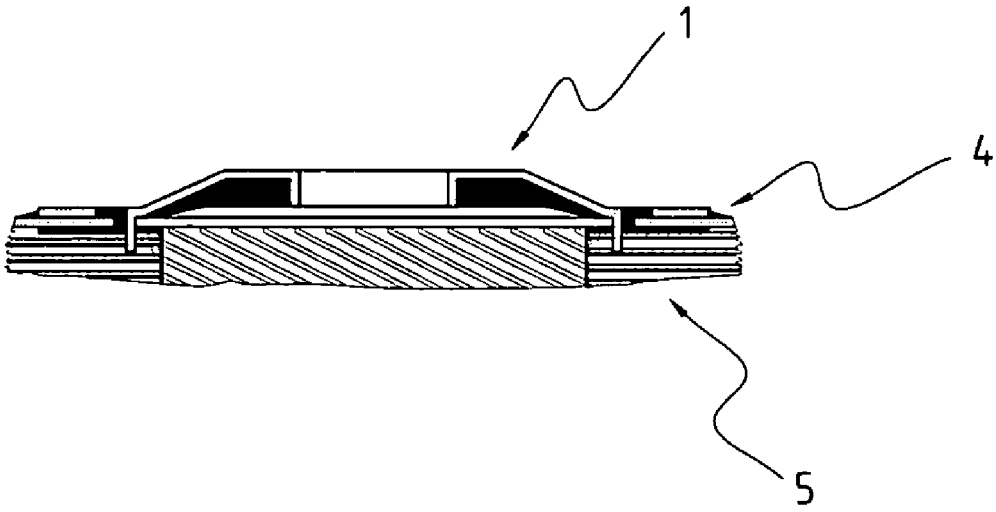
FIG. 10 is a schematic cross-sectional view showing the application of the embodiment in FIG. 7.

With reference to FIGS. 7, 8 and 9, the grinding ring 1 in accordance with the present invention has a centrally defined hole 11, a tubular extension 12 extending from a periphery defining the hole 11, an annular extension 13 extending from an outer periphery of the tubular extension 12 and a skirt 14 formed adjacent to the extension 13. Multiple teeth 15 are pressed at a joint between the annular extension 13 and the skirt 14 and multiple barbs 151 are respectively formed on the teeth 15. A disk 4 is sandwiched between the grinding ring 1 and the grinding wheel 5 and has a through hole 41 in communication with the hole 11 of the grinding ring 1. The grinding wheel 5 is made of multiple elongated cloth 51 stacked together to form a circle and has an aperture 52 in alignment with the through hole 41 of the disk 4. When the combination between the grinding ring 1 and the grinding wheel 5 is required, the disk 4 is placed on top of the grinding wheel 5 to align the through hole 41 with the aperture 52. Then the grinding ring 1 is placed on top of the disk 4. The grinding ring 1 is pressed downward to the disk 4. Due to the pressing process, the teeth 15 and the barbs 151 are formed and extended into the disk 4 and the grinding wheel 5. An adhesive 6 is applied from the hole 11 to fill the space between the grinding ring 1, the disk 4 and the grinding wheel 5 so that engagement between the grinding ring 1, the disk 4 and the grinding wheel 3 is enhanced. With reference to FIG. 10, it is to be noted that when a tool is employed to extend into the hole 11 to drive the combination of the grinding ring 1 and the grinding wheel 5, the periphery of the grinding wheel 5 as well as that of the disk 4 will be worn simultaneously.

Figure 11:
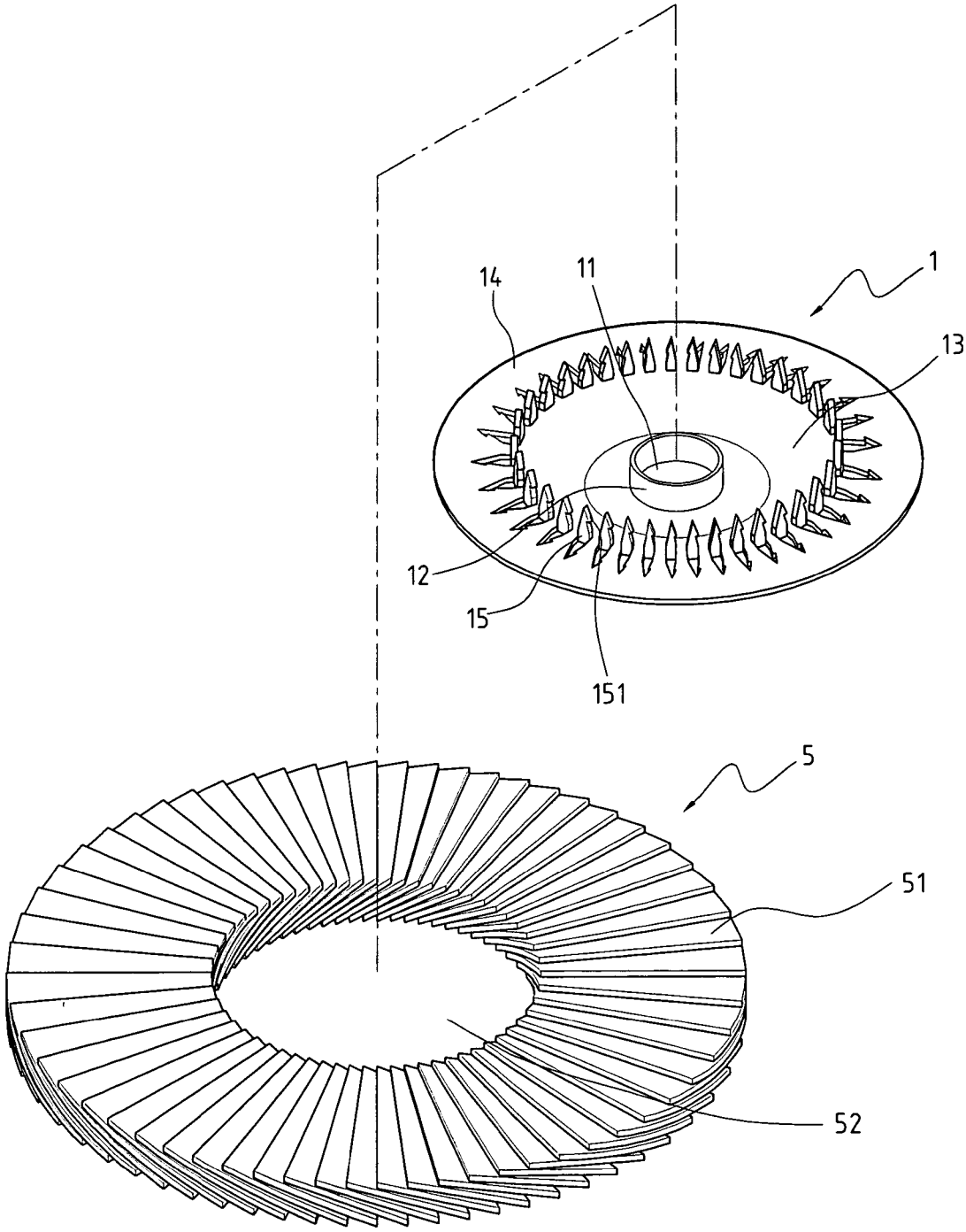
FIG. 11 is an exploded perspective view of another embodiment of the grinding ring and the grinding wheel.
Figure 12:
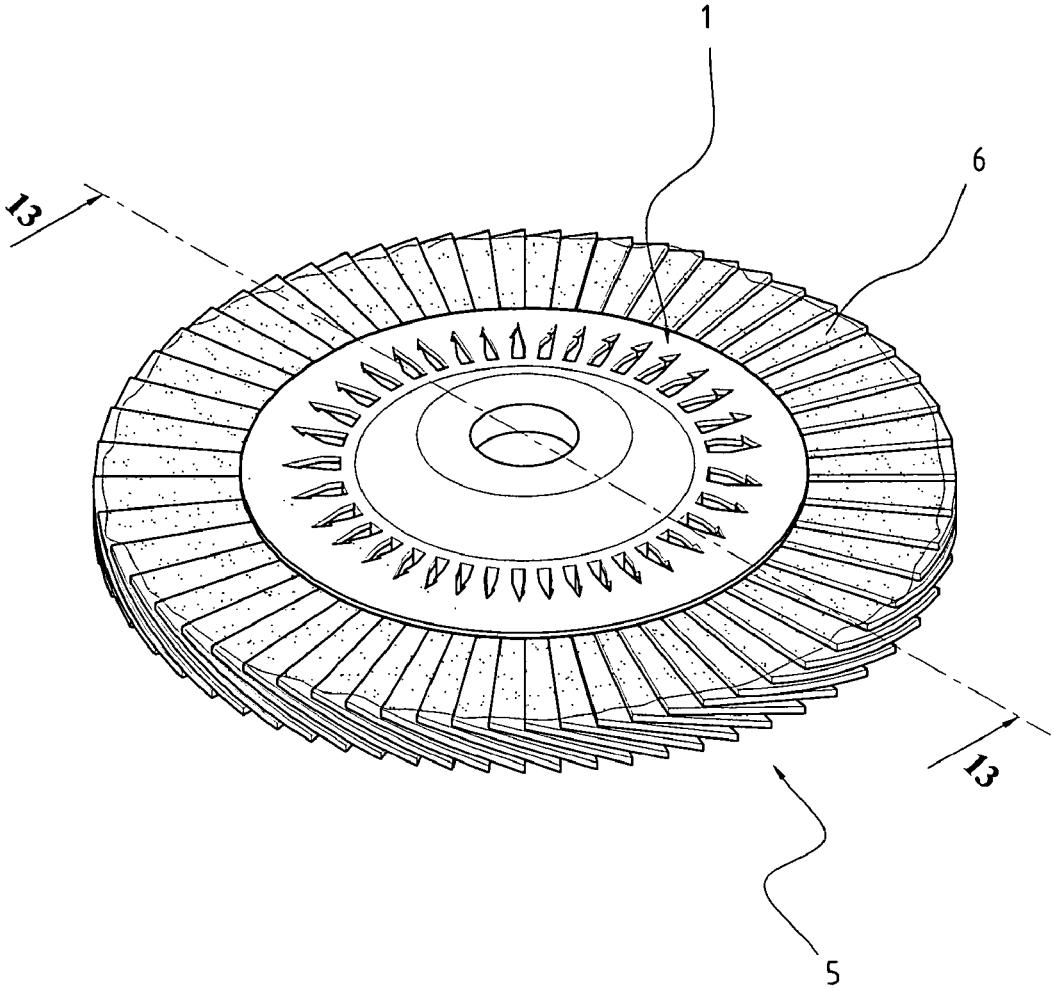
FIG. 12 is a perspective view showing the combination of the grinding ring and the grinding wheel in FIG. 11.
Figure 13:
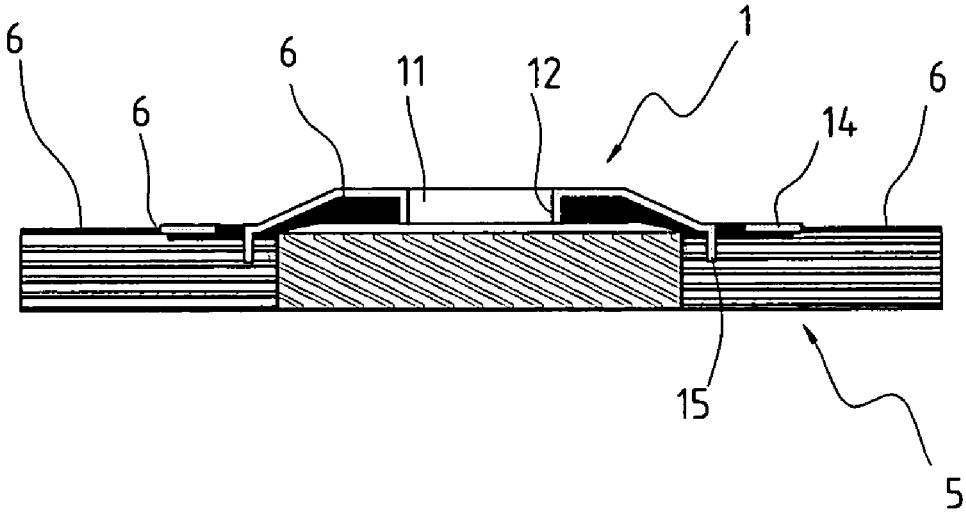
FIG. 13 is a cross-sectional view taken along line 13—13 in FIG. 12.
Figure 14:
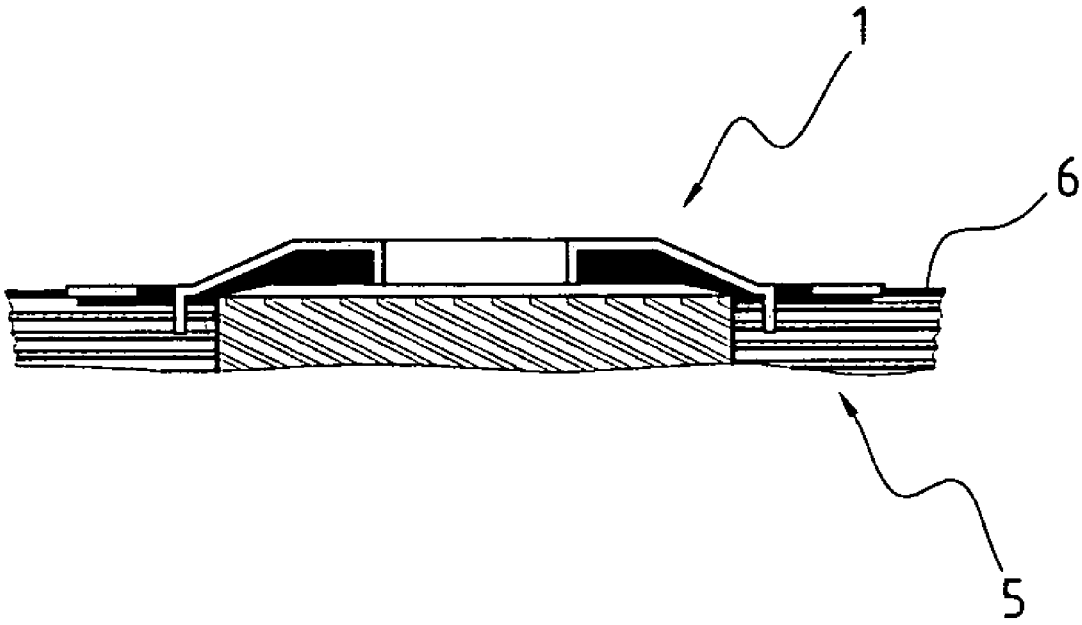
FIG. 14 is a schematic cross-sectional view showing the application of the embodiment in FIG. 11.
Figure 15:
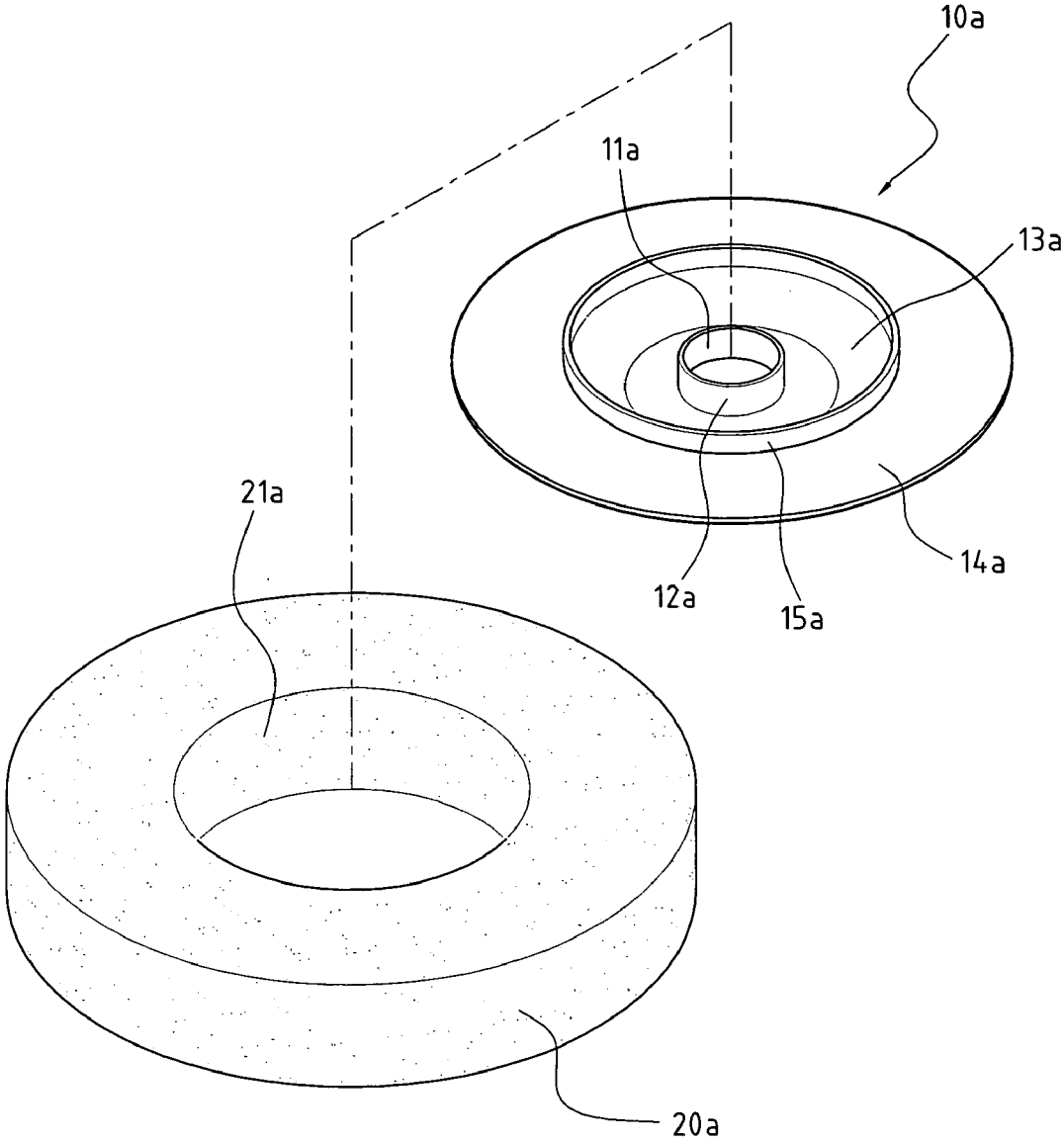
FIG. 15 is an exploded perspective view of a conventional grinding ring and the grinding wheel.
Figure 16:
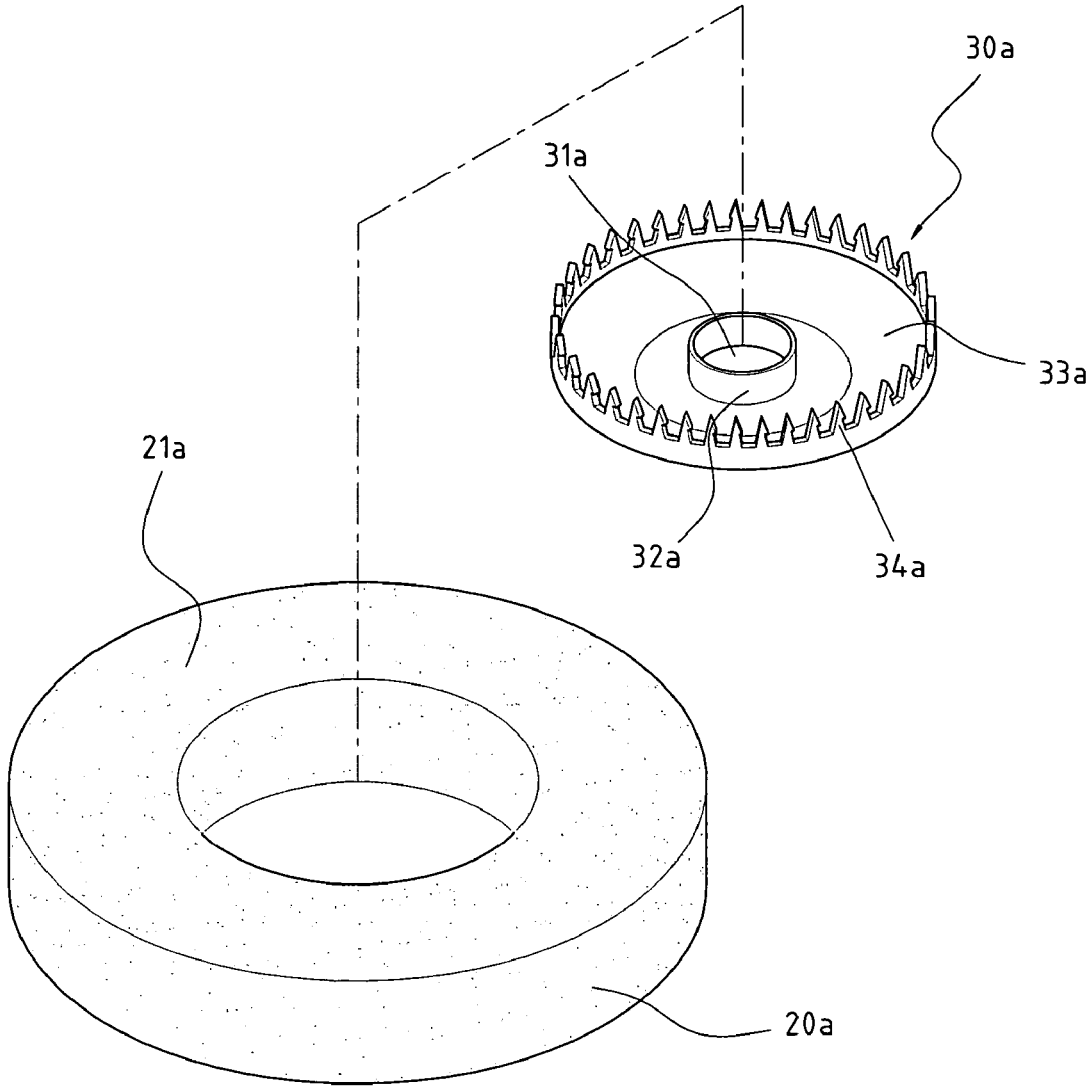
FIG. 16 is an exploded perspective view of a conventional grinding ring and the grinding wheel.
Figure 17:
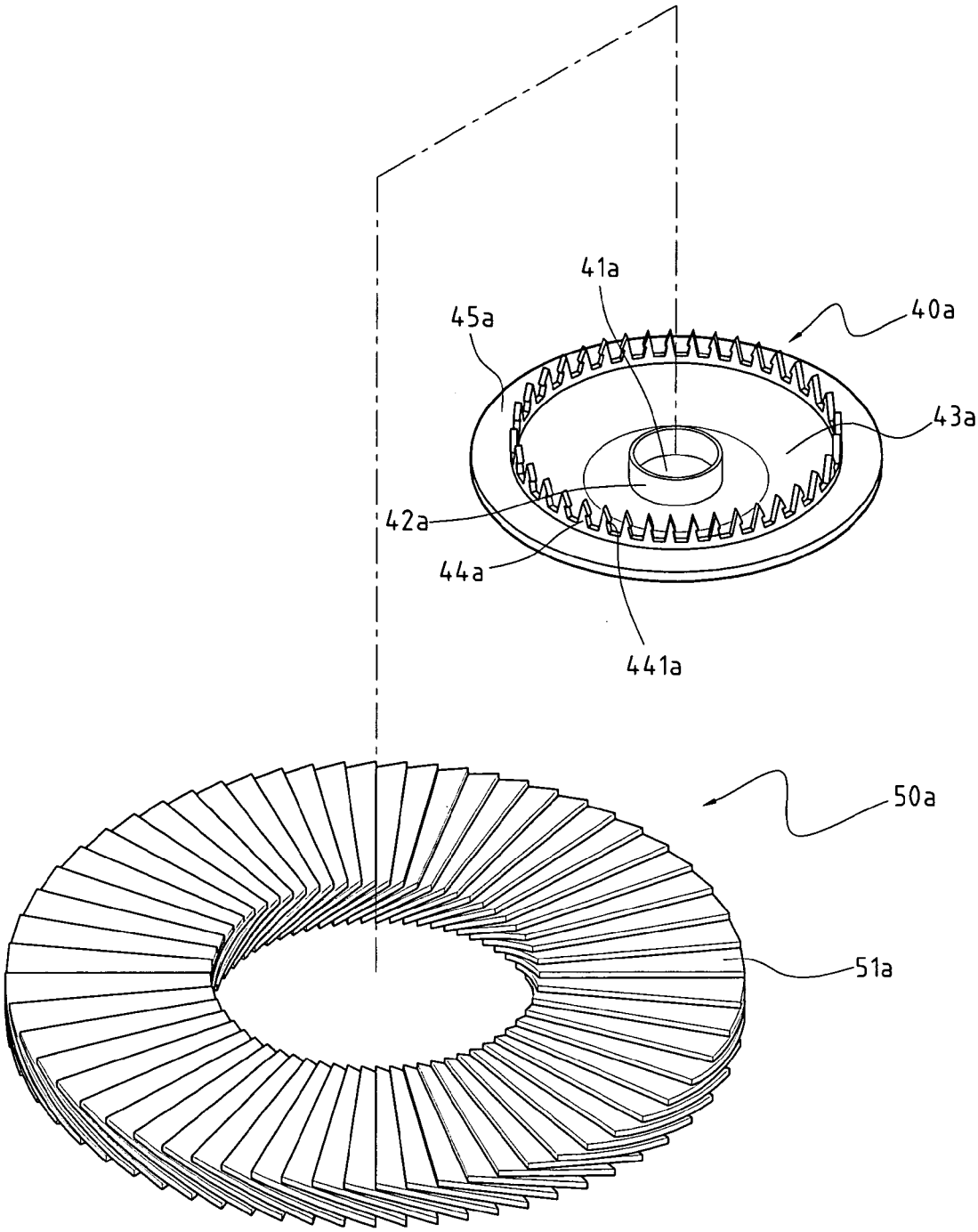
FIG. 17 is an exploded perspective view of a conventional grinding ring and the grinding wheel.

With reference to FIGS. 11, 12 and 13, the grinding ring 1 in accordance with the present invention has a centrally defined hole 11, a tubular extension 12 extending from a periphery defining the hole 11, an annular extension 13 extending from an outer periphery of the tubular extension 12 and a skirt 14 formed adjacent to the extension 13. Multiple teeth 15 are pressed at a joint between the annular extension 13 and the skirt 14 and multiple barbs 151 are respectively formed on the teeth 15. The grinding wheel 5 is made of multiple elongated cloth 51 stacked together to form a circle and has an aperture 52 in alignment with the hole 11 of the grinding ring 1. When the combination between the grinding ring 1 and the grinding wheel 5 is required, the grinding ring 1 is placed on top of the grinding wheel 5. The grinding ring 1 is pressed downward to the grinding wheel 5. Due to the pressing process, the teeth 15 and the barbs 151 are formed and extended into the grinding wheel 5. An adhesive 6 is applied from the hole 11 to fill the space between the grinding ring 1 and the grinding wheel 5 so that engagement between the grinding ring 1 and the grinding wheel 5 is enhanced. With reference to FIG. 14, it is to be noted that when a tool is employed to extend into the hole 11 to drive the combination of the grinding ring 1 and the grinding wheel 5, the periphery of the grinding wheel 5 as well as the adhesive 6 will be worn simultaneously.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A combination of grinding ring and grinding wheel, wherein:

the grinding ring has a centrally defined hole, a tubular extension extending from a periphery defining the hole, an annular extension extending from an outer periphery of the tubular extension, a skirt formed adjacent to the annular extension, teeth formed by pressing at a joint between the annular extension and the skirt and barbs each formed on a free end of the teeth, and the grinding wheel is made of cloth so that the teeth together with the barbs are able to extend into the grinding wheel when the skirt is pressed and engagement between the grinding ring and the grinding wheel is enhanced by applying an adhesive.

2. The combination of the grinding ring and the grinding wheel, wherein:

the grinding ring has a centrally defined hole, a tubular extension extending from a periphery defining the hole, an annular extension extending from an outer periphery of the tubular extension, a skirt formed adjacent to the annular extension, teeth formed by pressing at a joint between the annular extension and the skirt and barbs each formed on a free end of the teeth, and the grinding wheel is made of cloth and has an aperture in communication and alignment with the hole of the grinding ring, wherein a disk is sandwiched between the grinding ring and the grinding wheel and has a through hole in alignment with the aperture so that the teeth together with the barbs are able to extend into the disk and the grinding wheel when the skirt is pressed and engagement between the grinding ring and the grinding wheel is enhanced by applying an adhesive.

3. The combination of the grinding ring and the grinding wheel, wherein:

the grinding ring has a centrally defined hole, a tubular extension extending from a periphery defining the hole, an annular extension extending from an outer periphery of the tubular extension, a skirt formed adjacent to the annular extension, teeth formed by pressing at a joint between the annular extension and the skirt and barbs each formed on a free end of the teeth, and the grinding wheel is made of cloth stacked on top of one another to form circle and has an aperture in alignment with the hole of the grinding ring so that the teeth together with the barbs are able to extend into the grinding wheel when the skirt is pressed and engagement between the grinding ring and the grinding wheel is enhanced by applying an adhesive.

* * * * *